US006957629B1

(12) United States Patent
Steinhafel et al.

(10) Patent No.: US 6,957,629 B1
(45) Date of Patent: Oct. 25, 2005

(54) WATER HEATER FLUE WITH IMPROVED HEAT TRANSFER

(75) Inventors: Michael B. Steinhafel, Madison, WI (US); Donovan J. Wright, Stoughton, WI (US)

(73) Assignee: Bock Water Heaters, Inc., Madison, WI (US)

( * ) Notice: Subject to any disclaimer, the term of this patent is extended or adjusted under 35 U.S.C. 154(b) by 0 days.

(21) Appl. No.: 10/953,314

(22) Filed: Sep. 29, 2004

Related U.S. Application Data

(63) Continuation of application No. 10/922,441, filed on Aug. 20, 2004, now abandoned.

(51) Int. Cl.[7] ..... F22B 7/16
(52) U.S. Cl. ..... 122/155.2; 122/18.3
(58) Field of Search ..... 122/155.2, 18.3, 122/155.4, 367.3, 155.1, 13.01

(56) References Cited

U.S. PATENT DOCUMENTS

| | | | | |
|---|---|---|---|---|
| 2,687,747 | A | | 8/1954 | Bock |
| 2,950,740 | A | | 8/1960 | Bock |
| 3,349,754 | A | | 10/1967 | Bock |
| 3,600,548 | A | | 8/1971 | Bock |
| 4,239,953 | A | | 12/1980 | Bock |
| 4,328,791 | A | * | 5/1982 | Moore et al. ..... 126/586 |
| 4,383,163 | A | | 5/1983 | Sjöholm |
| 4,397,296 | A | * | 8/1983 | Moore et al. ..... 122/14.22 |
| 4,412,558 | A | | 11/1983 | Burke et al. |
| 4,543,943 | A | | 10/1985 | Gruber et al. |
| 4,660,541 | A | | 4/1987 | Moore |
| 4,753,833 | A | | 6/1988 | Fishgal et al. |
| 4,761,532 | A | | 8/1988 | Bock |
| 6,354,248 | B1 | | 3/2002 | Bourke |
| 6,675,746 | B2 | | 1/2004 | Gerstmann et al. |

OTHER PUBLICATIONS

"RESIDENTIAL The Invisible Luxury: Hot water on demand!", Bock Water Heaters brochure, 4 pp.
"We call these our Unique Applications You'll call them one of the wisest investments you'll ever make. The Invisible Luxury: High-efficiency space- and water heating for your home", Bock Water Heaters brochure, 4 pp.

* cited by examiner

*Primary Examiner*—Gregory Wilson
(74) *Attorney, Agent, or Firm*—Stiennon & Stiennon

(57) ABSTRACT

A water tank has a central flue to which clips are welded. The clips define baffles and are welded to have a greater heat transfer area where they are joined to the central flue. The individual clips are rectangular and are welded to the flue wall along one side at an angle of 4° rather than the 9° of the prior art so that the clip has a greater weld area. This greater weld area increases the thermal path between the clip and the wall of the central flue.

2 Claims, 2 Drawing Sheets

WATER HEATER FLUE WITH IMPROVED HEAT TRANSFER

CROSS REFERENCES TO RELATED APPLICATIONS

This application is a continuation of U.S. application Ser. No. 10/922,441 filed Aug. 20, 2004, now abandoned, the disclosure of which is incorporation by reference.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to heat transfer in a water heater in general, and to a water heater flue having heat exchange enhancing features on the inside of the flue in particular.

Heat exchange between a liquid and a gas is a process which has many industrial and domestic applications. Perhaps the most widely used domestic application of heat exchangers is domestic hot water which involves the transferring of heat from combustion gases to the water contained within a hot water heater. Typically a hot water heater has a tank which holds the water to be heated and a burner. The water is heated by the combustion of fuel with air in a burner to produce exhaust products which heat the bottom of the tank and are vented through a centrally located flue/heat exchanger which extends through the hot water tank. Two considerations which are paramount in the design of a hot water heater are durability and efficiency. Ever since the early 1970s there has been a heightened awareness of the importance of efficiency for cost, environmental, and geopolitical reasons. Efficiency is a measure of how effectively the heat energy present in the fuel is transferred to the water contained within the hot water heater tank.

Fuel is combusted with air to form hot gases that pass up through the central flue, exchanging heat with the wall of the flue and with the water contained within the water tank. It has long been known that internal baffles within the central flue can increase heat transfer between the flue gases and the water within the water tank. The baffles perform three basic functions: First, the baffles slow the passage of the combustion gases through the flue giving more time for heat transfer between the gases and the flue wall. Second, the baffles mix the combustion gases within the flue, bringing more of the flue gases into contact with the flue wall which transfers heat to the water. Third, the baffles conduct heat to the wall of the flue.

Water heaters with baffles in the flue have proven to have good heat transfer and durability. However, even small improvements in overall efficiency are desirable.

SUMMARY OF THE INVENTION

The water heater of this invention employs a water tank with a central flue to which clips forming baffles are welded. The invention being an improvement whereby the clips have a greater heat transfer area at the point where they are welded to the central flue. In existing water heaters rectangular metal clips are welded to a tubular central flue. The metal clips measuring, for instance, two inches by ⅝ of an inch by ⅛th of an inch, are welded so that the 2-inch dimension of the clip extends radially inwardly of a 5¾ inch circumferential wall of the tubular central flue. The clips are oriented with the ⅝-inch dimension at a 15° angle to the axis of the tubular central flue. The clips extend in a spiral along the axis of the central flue with a rifling twist of one turn in ⅞ inches in the axial direction. The individual clips in the past have been welded to the flue wall along one ⅝×0.125 side at an angle of 9° so that the radial inwardly positioned edge is tipped upwardly. The water heater of this invention has an angle of 4° along the ⅝×0.125 side welded to the flue. This angle increases the thermal path between the clip and the flue wall by about 50 percent. The clip is heated by combustion gases moving upwardly through the central flue and transfers heat by conduction to the wall of the central flue which is in contact with water to be heated.

It is a feature of the present invention to improve the efficiency of a water heater by changing the angle with which baffles formed by clips are welded to a central tubular flue.

Further objects, features and advantages of the invention will be apparent from the following detailed description when taken in conjunction with the accompanying drawings.

DESCRIPTION OF THE PREFERRED EMBODIMENTS

Figure 1:
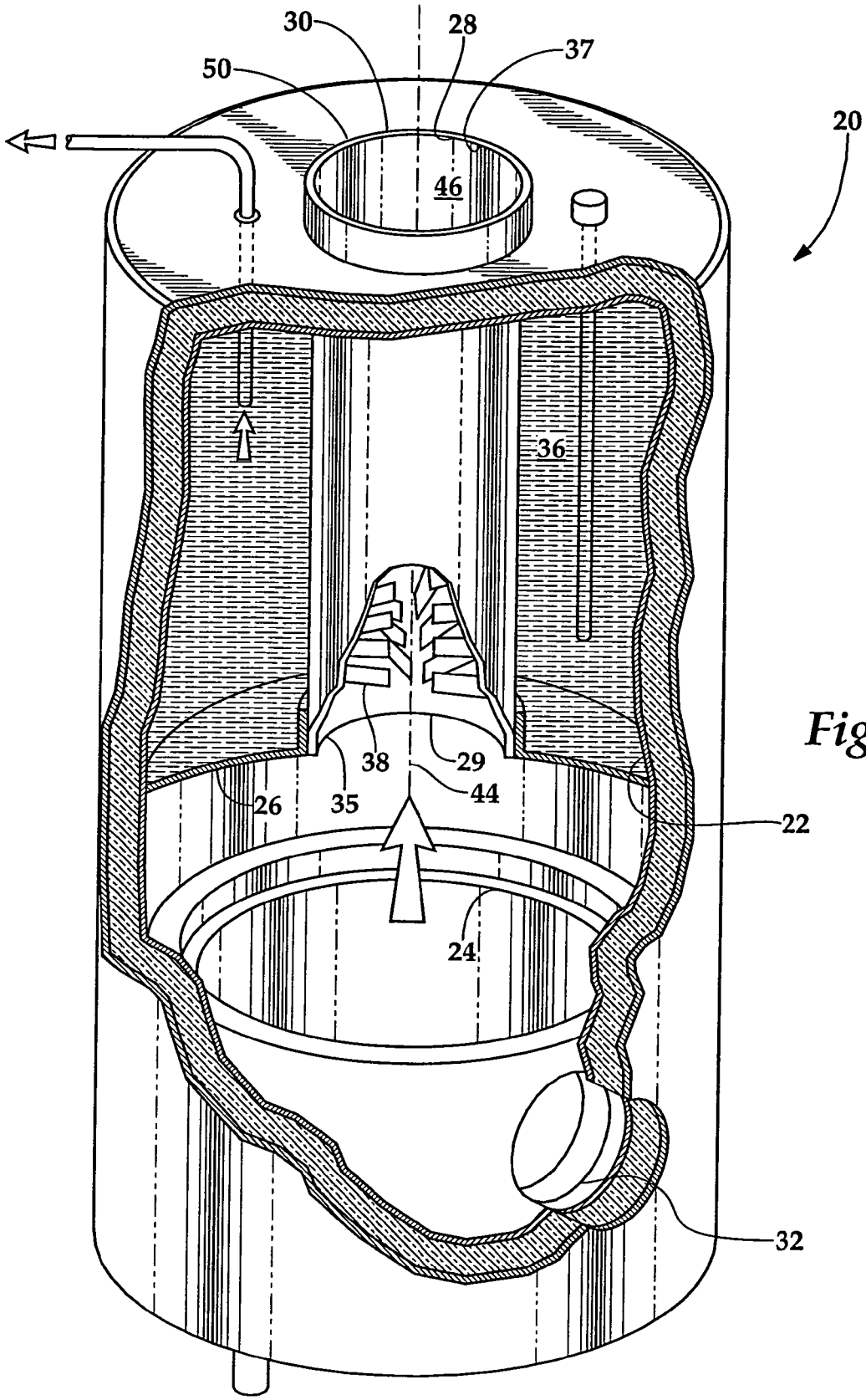
FIG. 1 is a side elevational isometric view partially cut away in section of the water heater of this invention.
Figure 2:
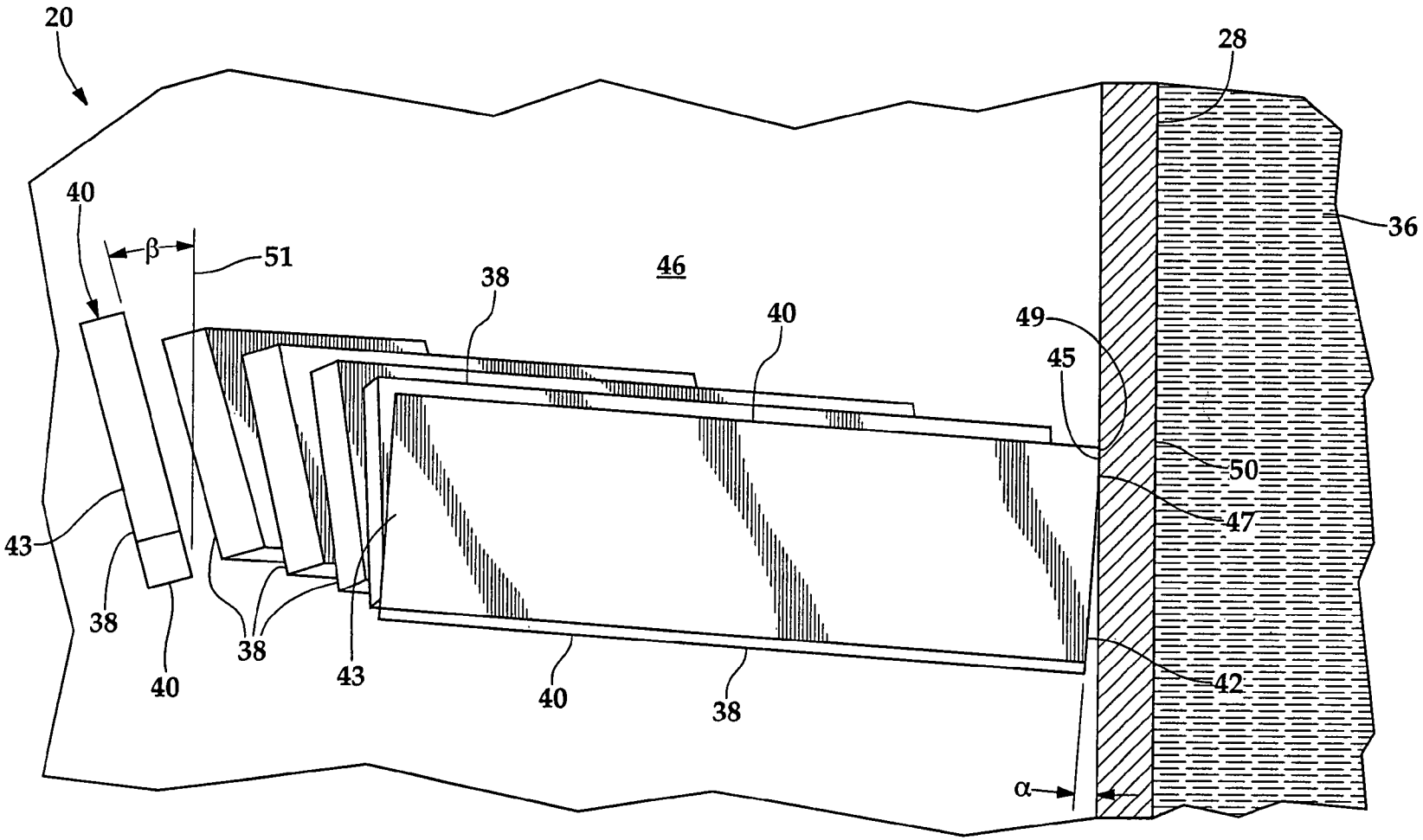
FIG. 2 is a fragmentary cross-sectional view of the water heater flue of the water heater of FIG. 1.

Referring more particularly to FIGS. 1–2, wherein like numbers refer to similar parts, a water heater 20 is shown in FIG. 1. The water heater 20 has a water tank 22 which is separated from combustion chamber 24 by a dome 26. A central mild steel flue 28 extends between an opening 29 in the dome 26 and the top 30 of the water heater tank 22. A burner (not shown) is positioned in an opening 32 leading into a combustion chamber 24 which may contain a ceramic crucible surrounded by insulating fiber or where the firebox may be formed by ceramic fiber insulation alone. The burner may operate on oil, natural gas or propane or other fuel. The exhaust gases from the burner flow upwardly through the central flue 28 from the flue inlet 35 to the flue outlet 37, exchanging heat with the water 36 contained within the water tank 22.

Heat is exchanged between the dome 26 and the central flue 28 and the water 36 contained in the water tank 22 of the water heater 20. As hot combustion gases flow up through the central flue 28, the flow of hot combustion gases is impeded by a multiplicity of mild steel clips 38. Each clip 38 has a generally rectangular plan, and is two long sides 40 and two short sides 42, 43. The central flue 28 is cylindrical and defines an axis 44 and an interior cylindrical surface 46.

As best shown in FIG. 2, each clip 38 in addition to having a thickness of for example ⅛ or ¼ inches, has a generally rectangular shape, having a first short side 42 and a second short side 43 of the same dimension, and two longer sides 40. The long sides 40 extend from the interior surface 46 of the flue 28 radially inwardly substantially toward the axis 44 of the cylindrical flue.

Each clip 38 first short side 42 has a portion 45, formed by the thickness of the clip along the short side, which is welded to a portion 49 of the interior surface of the flue 28. The clip short sides 42, 43 are angled at an angle $\beta$ of about 15° with respect to a projection 51 of the cylindrical flue axis 44 onto the interior surface 46 of the cylindrical flue 20 at the portion 49 of the flue to which the flue is welded. The plane containing the clip is angled 15 degrees to the axis 44 of the cylindrical flue 28. The first short side 42 and second short side 43 define a plane which intersects the interior surface of the flue, and wherein the first short side makes an angle of approximately 4° with respect to the intersection of the defined plane and the interior surface 46 of the flue 28. The clip is tilted upwardly as it is welded to the flue interior surface, such that the clip short side 42 defines an angle $\alpha$ of approximately 4° with respect to the flue interior surface at a line of attachment.

Because of the 4° angle at which the first short side 42 engages the interior surface 46, the second short side 43 of the clip is displaced upwardly toward the flue inlet by an amount which corresponds to the sine of 4° times the cosine of 15° times the length of the long side 40.

The clips are arranged to form a spiral with a rifling of about one turn in about 1.4 times the length of the short side. The dimensions of the clips 38 may be for example ⅛"×⅝"×2" or ¼"×1"×3".

Heat exchange is facilitated by the presence of the steel clips 38. The principal action of the steel clips is to generate turbulence. Turbulence is desirable to prevent a laminar flow of gases through the flue. In a laminar flow, hot gases which did not enter the flue adjacent the flue wall 50 would not exchange heat directly with the flue wall 50. A secondary mechanism by which the steel clips 38 facilitate heat exchange between hot gases rising through the flue 28 and the water 36 within the tank 22 is by conduction. The blades, which are typically two or three inches long, extend out into the flow of exhaust gases and conduct heat to the wall 50 of the flue 28.

For heat to flow from the steel clips 38 to the wall 50 of the flue 28, the heat must flow through the weld 47 adjoining the clip to the flue wall 50. This flow of heat from the steel clips 38 to the wall 50 is a relatively minor component of the total heat flow. For the flue of a 50 gallon water heater having a flue 5¾ inches in inside diameter and 41 inches long in contact with the water 36, the total area in contact with the water is approximately 750 inches square. A prior art flue having 646 clips with dimensions of ⅛"×⅝"×2" welded with the first short side 42 at an angle of 9° has a weld area of ¼"×0.125" or 0.03125 $in^2$ for each clip. Thus the total clip contact area, i.e., the sum of the 646 weld areas 47 (0.03125 $in^2$×646) is about 20 $in^2$ or about 3 percent of the total flue area. It is likely heat flow through this area contributes about 2–4 percent to the total heating. In the improved water heater 20 of this invention, the weld angle $\alpha$ is about 4° which produces a weld area of ⅜"×0.125" or 0.047 $in^2$. For a flue having 646 clips, the total weld contact area (0.047 $in^2$×646) would be about 30 $in^2$, or about 50 percent greater, or about four and one half percent of the total flue area. Thus it is expected that the increased weld area increases water heater efficiency by 1 percent or 2 percent.

The clips 38 are attached by spot welding with a device such as described in U.S. Pat. No. 4,761,532 to Bock, which is incorporated herein by reference. The orientation of the clip 38 is controlled by a welding head which positions, orients, and holds the clip 38 against the inside surface 46 of the flue 28. The tolerance for the angle $\alpha$ is better than plus or minus 1°. Conventionally it is desirable to minimize the size of the weld 47 because of the additional power and welding dine required. However, despite the relative small contribution the weld 47 makes to heat flow, such contributions can be critical in meeting certain regulatory standards, or benchmarks for thermal efficiency. In increasing the weld size from the 0.03 to 0.047 inches squared required a 50 percent increase in weld time from 40 milliseconds to 60 milliseconds and an increase in welding current by 500 amps.

It is understood that the invention is not limited to the particular construction and arrangement of parts herein illustrated and described, but embraces all such modified forms thereof as come within the scope of the following claims.

We claim:

1. A water heater flue comprising:

a cylindrical flue defining a cylindrical axis, an interior cylindrical surface, a flue inlet, and a flue outlet, the cylindrical flue having a plurality of mild steel clips welded to the interior surface;

wherein each clip has a thickness and generally rectangular shape, the clip having a first short side and a second short side of the same length which are joined by two long sides to define the rectangular shape, the long sides extending from the interior surface radially inwardly substantially toward the axis of the cylindrical flue;

wherein the first short side has a portion formed by the thickness of the clip along the first short side which is welded to a portion of the interior surface of the cylindrical flue, and wherein the first short side and second short side are angled about 15° with respect to a projection of the cylindrical flue axis onto the interior surface at the portion of the interior surface of the cylindrical flue; and wherein the first short side and second short side define a plane, the plane intersecting the interior surface of the flue, and wherein the first short side makes an angle of approximately 4° with respect to the intersection of the defined plane and the interior surface of the flue, the clip second short side being displaced upwardly toward the flue inlet;

wherein the clips are arranged to form a spiral about the interior of the flue.

2. A water heater comprising:

a water tank;

a burner chamber positioned below the water tank;

a central cylindrical flue penetrating the water tank, the cylindrical flue defining a cylindrical axis, and an interior cylindrical surface, a flue inlet, and a flue outlet, the cylindrical flue having a plurality of mild steel clips welded to the interior surface, the clips being arranged in a spiral;

wherein each clip has a thickness and generally rectangular shape, the clip having a first short side and a second short side of the same length which are joined by two long sides to define the rectangular shape, the long sides extending from the interior surface radially inwardly substantially toward the axis of the cylindrical flue;

wherein the first short side has a portion formed by the thickness of the clip along the first short side which is welded to a portion of the interior surface of the cylindrical flue, and wherein the first short side and second short side are angled about 15° with respect to a projection of the cylindrical flue axis onto the interior surface at the portion of the interior surface of the cylindrical flue; and wherein the first short side and second short side define a plane, the plane intersecting the interior surface of the flue, and wherein the first short side makes an angle of approximately 4° with respect to the intersection of the defined plane and the interior surface of the flue, the clip second short side being displaced upwardly toward the flue inlet;

wherein the clips are arranged to form a spiral about the interior of the flue.

* * * * *